United States Patent [19]

Berendt et al.

[11] Patent Number: 4,613,335

[45] Date of Patent: Sep. 23, 1986

[54] PROCESS FOR DYEING OR PRINTING CELLULOSE-CONTAINING TEXTILE MATERIAL WITH VAT DYE FOAM

[75] Inventors: Hans-Ulrich Berendt, Allschwil; Paul Schäfer, Riehen, both of Switzerland

[73] Assignee: Ciba-Geigy Corporation, Ardsley, N.Y.

[21] Appl. No.: 733,346

[22] Filed: May 13, 1985

[30] Foreign Application Priority Data

May 18, 1984 [CH] Switzerland ..... 2456/84

[51] Int. Cl.[4] ..... D06P 1/22; D06P 3/60

[52] U.S. Cl. ..... 8/477; 8/532; 8/554; 8/555; 8/650; 8/653; 8/918

[58] Field of Search ..... 8/477, 650, 653, 555, 8/554

[56] References Cited

U.S. PATENT DOCUMENTS

| | | | |
|---|---|---|---|
| 2,544,909 | 3/1951 | Wright | 8/528 |
| 2,559,269 | 7/1951 | Zinner | 8/528 |
| 3,990,840 | 11/1976 | von der Eltz et al. | 8/477 |
| 4,275,656 | 6/1981 | Choma | 8/477 |
| 4,345,909 | 8/1982 | Guth et al. | 8/477 |
| 4,413,998 | 11/1983 | Guth et al. | 8/477 |
| 4,494,956 | 1/1985 | Schafer et al. | 8/543 |

FOREIGN PATENT DOCUMENTS

| | | |
|---|---|---|
| 98803 | 1/1984 | European Pat. Off. . |
| 871193 | 6/1961 | United Kingdom . |

*Primary Examiner*—A. Lionel Clingman

*Attorney, Agent, or Firm*—Edward McC. Roberts; Meredith C. Findlay

[57] ABSTRACT

Textile cellulose material is dyed or in particular printed with vat dyes by applying to the cellulose material in the absence of air a foamed aqueous preparation which, in addition to the dye, alkalis, reducing agent, foam-forming agent, preferably also contains a homopolymer or copolymer of acrylamide or methacrylamide or in particular a graft polymer which is obtained from an adduct of an alkylene oxide, preferably propylene oxide, on an at least trihydric aliphatic alcohol, for example glycerol, and acrylamide or methacrylamide.

The dyed or printed cellulose material is if desired subjected to a heat treatment, for example steaming, and is then oxidized to develop the color.

The use of the foamed preparations makes it possible to obtain deep level dyeings and crisp prints without the use of thickeners; at the same time the textile materials thus obtained have excellent handle.

24 Claims, No Drawings

PROCESS FOR DYEING OR PRINTING CELLULOSE-CONTAINING TEXTILE MATERIAL WITH VAT DYE FOAM

The present invention relates to a process for dyeing or printing cellulose-containing textile material with vat dyes by means of foam. The process comprises using, in the absence of air, a foamed aqueous preparation which contains dyes, foam-forming agents, reducing agents, alkalis and preferably also a homopolymer or copolymer of acrylamide or methacrylamide or a graft polymer which is obtainable from an adduct of an alkylene oxide on an at least trihydric aliphatic alcohol having 3 to 10 carbon atoms and acrylamide or methacrylamide. The preparation can also contain mixtures of the polymers mentioned.

The foam application process can be carried out with or without polymers based on acrylamide or methacrylamide, but it is preferable for the foamed preparation to contain these polymers.

The amounts in which the acrylamide polymers are added alone or as mixtures to the preparations to be foamed can vary, according to the process, between 0.5 and 20 g/l in the form of aqueous solutions. For instance, amounts of 0.5 to 10 g, preferably 1 to 5 g, in the form of 2 to 10% aqueous solutions per liter of unfoamed preparation have been found to be advantageous.

The acrylamide- or methacrylamide-based polymers used according to the invention are preferably the graft polymers of the type defined.

Preferred graft polymers are obtainable by graft polymerisation of methacrylamide or in particular acrylamide on an adduct of 4 to 100 mol, preferably 40 to 80 mol, of propylene oxide on trihydric to hexahydric alkanols having 3 to 6 carbon atoms. These alkanols can be straight-chain or branched. Examples are glycerol, trimethylolethane, trimethylolpropane, erythritol, pentaerythritol, mannitol and sorbitol.

Further suitable graft polymers are those which are prepared by grafting methacrylamide or acrylamide onto adducts of mixtures of ethylene oxide and propylene oxide or of ethylene oxide alone on the polyhydric alcohols mentioned.

Graft polymers which have been found to be specially suitable are in particular those obtained from acrylamide and adducts of 40 to 80 mol of propylene oxide on 1 mol of glycerol.

The graft polymers which are used according to the invention advantageously contain 2.5 to 50% by weight of the defined adduct as the main chain and 50 to 97.5% by weight of grafted-on methacrylamide or preferably acrylamide as side chains.

Preferably the graft polymers have 2.5 to 30% by weight of the alkylene oxide adduct of the type defined and 70 to 97.5% by weight of grafted-on methacrylamide or in particular acrylamide. Even more preferably, the amide content is 80 to 97.5% by weight, based on the graft polymer.

Of these products, particular preference is given to those which contain as the main chain 4 to 20% by weight of the adduct of 40 to 80 mol of propylene oxide on 1 mol of glycerol and 80 to 96% by weight of acrylamide.

The indicated percentages are based on the whole graft polymer.

The graft polymers used according to the invention are prepared by methods known per se, advantageously by polymerising, advantageously at a temperature of 40° to 100° C., (1) an adduct of an alkylene oxide on an at least trihydric aliphatic alcohol of 3 to 10 carbon atoms with (2) acrylamide or methacrylamide in the presence of catalysts. The products obtained are thus predominantly graft polymers in which the alklene oxide adduct forms the main chain which contains the grafted-on acrylamide or methacrylamide in the form of side chains attached to individual carbon atoms.

The catalysts used are advantageously organic or preferably inorganic initiators which form free radicals. Examples of suitable organic initiators for carrying out the free-radical polymerisation are symmetrical peroxodicarbonates, butyl peroctoates, butyl perbenzoates, peracetates and peroxodicarbamates. Suitable inorganic initiators are hydrogen peroxide, perborates, persulfates and peroxodisulfates.

The preferred initiator or activator is potassium peroxodisulfate.

These catalysts can be used in amounts of 0.05 to 5 percent by weight, advantageously 0.05 to 2 percent by weight and preferably 0.1 to 1 percent by weight, based on the starting materials.

The graft polymerisation is advantageously carried out in an inert atmosphere, for example in a nitrogen atmosphere.

The graft polymers are obtained as very viscous materials. By dissolving and diluting with water it is possible to prepare gellike products having a solids content of, for example, 0.5 to 20% by weight, preferably 2 to 20% by weight. To preserve and/or improve the shelf life of the aqueous graft polymer solutions obtained, it is possible to add preservatives, for example chloroacetamide, N-hydroxymethylchloroacetamide, pentachlorophenolates, alkali metal nitrites, triethanolamine or preferably hydroquinone monomethyl ether, or also antibacterial agents, for example sodium azide or surface-active quaternary ammonium compounds which have one or two fatty alkyl radicals. Advantageously it is also possible to use mixtures of these preservatives and germicidal compounds.

The particularly preferred 2 to 5% solutions of the graft polymers obtained have at 25° C. a viscosity of 3,000 to 150,000, preferably 15,000 to 120,000 and in particular 40,000 to 80,000, mPas (millipascalsecond). The polyalkylene oxide adducts used for preparing the graft polymers generally have a molecular weight of 400 to 6,000, preferably 3,000 to 4,500.

In the foam application process it is also possible to use—in place of the graft polymers mentioned—linear or branched polymers of acrylamide or methacrylamide and copolymers of acrylamide or methacrylamide and further ethylenically unsaturated monomers, for example acrylic acid, methacrylic acid, $\alpha$-halogenoacrylic acid, 2-hydroxyethylacrylic acid, $\alpha$-cyanoacrylic acid, crotonic acid, vinyl acetic acid, maleic acid, acrylonitrile, methacrylonitrile, vinyl alkyl ethers (methyl vinyl ether, isopropyl vinyl ether), vinyl esters (vinyl acetate), styrene, vinyltoluene, vinylsulfonic acid, 2-acrylamido-2-methylpropanesulfonic acid or esters of said $\alpha,\beta$-unsaturated carboxylic acids and especially half-esters of maleic acid with adducts of 2 to 15 mol of ethylene oxide on monoalcohols having 8 to 22 carbon atoms. The weight ratio of the acrylamide to the other monomers is preferably 9:1 to 1:1.

Suitable foam-forming agents are generally anionic or nonionic compounds which have surface-active properties and which are referred to hereinafter as surfactants. Surfactants reduce the surface tension of solutions and facilitate and hence stabilise foam formation. Both anionic and nonionic surfactants can be present as individual compounds, as mixtures with one another or as combinations of anionic and nonionic surfactants.

Examples of suitable anionic surfactants are:

sulfated aliphatic alcohols, whose alkyl chain has 8 to 18 carbon atoms, for example sulfated lauryl alcohol;

sulfated unsaturated fatty acids or fatty acid lower alkyl esters which have 8 to 20 carbon atoms in the fatty radical, for example ricinoleic acid, and oils containing these fatty acids, for example castor oil;

alkylsulfonates whose alkyl chain contains 8 to 20 carbon atoms, for example dodecylsulfonate or pentadecylsulfonate;

alkylarylsulfonates having one or two straight-chain or branched alkyl chains having a total of at least 6 carbon atoms, for example dodecylbenzenesulfonates, dibutylnaphthalenesulfonates or 3,7-diisobutylnaphthalenesulfonates;

sulfonated 1-benzyl-2-alkylbenzimidazoles having 8 to 22 carbon atoms in the alkyl radical;

sulfonates of polycarboxylate esters, for example dioctyl sulfosuccinates or sulfosuccinamides;

soaps—the alkali metal, ammonium or amine salts of fatty acids having 10 to 20 carbon atoms, for example colophony salts;

esters of polyalcohols, in particular monoglycerides or diglycerides of fatty acids having 12 to 18 carbon atoms, for example monoglycerides of lauric, stearic or oleic acid; and the esterified—into an acid ester (with an organic dicarboxylic acid, for example maleic acid, malonic acid or sulfosuccinic acid, but preferably with an inorganic polybasic acid, for example o-phosphoric acid or in particular sulfuric acid)—adducts of 1 to 60, preferably 2 to 30, mol of ethylene oxide and/or propylene oxide on fatty amines, fatty amides, fatty acids or fatty alcohols each having 8 to 22 carbon atoms, on alkylphenols having 4 to 16 carbon atoms in the alkyl chain, o-phenylphenol or benzylphenol or on trihydric to hexahydric alkanols having 3 to 6 carbon atoms.

The acid radical of these anionic surfactants is generally present in salt form, i.e. for example as alkali metal salt, ammonium salt or amine salt. Examples of these salts are lithium, sodium, potassium, ammonium, trimethylamine, ethanolamine, diethanolamine or triethanolamine salts.

Anionic surfactants which are highly suitable for use as foam-forming agents are (1) acid esters or their salts of a polyadduct of 2 to 15 mol of ethylene oxide on 1 mol of fatty alcohol having 8 to 22 carbon atoms or on 1 mol of alkylphenol having 4 to 12 carbon atoms in the alkyl radical;

(2) alkylsulfates whose alkyl chain contains 8 to 20 carbon atoms, for example laurylsulfate;

(3) alkylphenylsulfonates having 8 to 18 carbon atoms in the alkyl radical; or (4) dialkylnaphthalenesulfonates having 3 to 5 carbon atoms per alkyl radical.

Said components (1) to (4) can be used as foam-forming agents by themselves or as mixtures with one another.

The nonionic surfactant is advantageously a nonionic alkylene oxide adduct of 1 to 100 mol of alkylene oxide, for example ethylene oxide and/or propylene oxide, on 1 mol of an aliphatic monoalcohol having at least 4 carbon atoms, a 3- to 6-hydric aliphatic alcohol, a phenol which can be substituted by alkyl or phenyl, or a fatty acid having 8 to 22 carbon atoms.

Examples of nonionic surfactants are:

fatty alcohols having 8 to 22 carbon atoms, especially cetyl alcohol;

adducts of preferably 2 to 80 mol of alkylene oxides, in particular ethylene oxide, where individual ethylene oxide units can be replaced by substituted epoxides, such as styrene oxide and/or propylene oxide, on higher unsaturated or saturated monoalcohols, fatty acids, fatty amines or fatty amides having 8 to 22 carbon atoms or on phenylphenol or alkylphenols whose alkyl radicals have at least 4 carbon atoms;

alkylene oxide, in particular ethylene oxide and/or propylene oxide condensation products (block polymers);

reaction products of a fatty acid having 8 to 22 carbon atoms and a primary or secondary amine having at least one hydroxy-lower-alkyl or lower-alkoxy-lower-alkyl group or alkylene oxide adducts of these hydroxyalkyl-containing reaction products, the reaction being such that the molecular ratio between hydroxyalkylamine and fatty acid can be 1:1 or greater than 1, for example 1.1:1 to 2:1; and adducts of propylene oxide on a trihydric to hexahydric aliphatic alcohol of 3 to 6 carbon atoms, for example glycerol or pentaerythritol, the polypropylene oxide adducts having an average molecular weight of 250 to 1,800, preferably 400 to 900.

Nonionic surfactants which are highly suitable for use as foam-forming agents are:

(5) adducts of 2 to 15 mol of ethylene oxide on 1 mol of aliphatic monoalcohol or fatty acid each having 8 to 22 carbon atoms or on mol of alkylphenol having a total of 4 to 12 carbon atoms in the alkyl moiety, and (6) fatty acid dialkanolamides having 8 to 22 carbon atoms in the fatty acid radical and 2 to 6 carbon atoms in the alkanol moiety.

Further highly suitable nonionic surfactants are block polymers of the formula $$R-O-(CH_2CH_2-O)_{n1}-(\underset{Z_1}{CH}-\underset{Z_2}{CH}-O)_y-(CH_2CH_2O)_{n2}-H \quad (1)$$

or of the formula $$R-O-(\underset{Z_1}{CH}-\underset{Z_2}{CH}-O)_{y1}-(CH_2CH_2O)_x-(\underset{Z_1}{CH}-\underset{Z_2}{CH}-O)_{y2}-H \quad (2)$$

in which R is hydrogen, alkyl or alkenyl having at most 18 carbon atoms, preferably 8 to 16 carbon atoms, o-phenylphenyl or alkylphenyl having 4 to 12 carbon atoms in the alkyl moiety, one of $Z_1$ and $Z_2$ is hydrogen and the other is methyl, y is 1 to 75, preferably 3 to 50, x is 1 to 30 and the sum $n_1+n_2$ is 3 to 30, preferably 3 to 15, and the sum $y_1+y_2$ is 2 to 30, preferably 4 to 20, and n2 and $y_2$ can also be 0.

Preferred block polymers of the formula (1) are those in which R is alkyl or alkenyl of 4 to 18, preferably 8 to 16, carbon atoms, y is 1 to 15, preferably 3 to 15, $n_1$ is 3 to 15 and $n_2$ is 0.

Particular advantageous block polymers are fatty alcohol polyglycol coethers, in particular adducts of 3 to 10 ethylene oxide and 3 to 10 mol of propylene oxide on aliphatic monoalcohols of 8 to 16 carbon atoms, preferably alkanols of 8 to 16 carbon atoms.

These block polymers are advantageously composed to 10 to 50 percent by weight of units which are derived from ethylene oxide and to 50 to 90 percent by weight of units which are derived from propylene oxide, and have a molecular weight of 250 to 6,000, in particular 350 to 3,000.

The nonionic surfactant can also be a siloxan-eoxyalkylene copolymer. This type of polymer is a reaction product of halogen-substituted organopolysiloxanes and alkali metal salts of polyoxyalkylene, for example polyethylene glycol or polypropylene glycol. Compounds of this type are described for example in European Pat. No. 30,919 or 49,832.

Preferred block polymers and siloxane-oxyalkylene copolymers which are used as foam-forming agents or foam moderators advantageously have a cloud point of 15° to 70° C., preferably 25° to 50° C. The cloud point is determined for example in accordance with DIN 53,917.

The foam-forming agents used according to the invention are advantageously used in the form of mixtures of the abovementioned anionic and/or nonionic surfactants.

In addition to the anionic and/or nonionic surfactants mentioned, the foam-forming mixtures can also contain quaternary ammonium salts. The latter can be prepared for example by reacting aliphatic fatty amines whose alkyl or alkenyl radicals have 8 to 24 carbon atoms, for example dodecylamine, hexadecylamine, heptadecylamine, octadecylamine, tallowamine, behenylamine or oleylamine or diamines and triamines, for example dodecylpropylenediamine, octadecylethylenediamine and octadecyldiethylenetriamine, with 1 to 35 equivalents of an alkylene oxide, for example propylene oxide, but especially ethylene oxide or a mixture of propylene oxide and ethylene oxide, and optionally in addition with 1 to 2 equivalents of styrene oxide and by subsequent reaction with customary quaternising agents, for example methyl halide, ethyl halide, benzyl halide, diethyl sulfate and especially dimethyl sulfate, halogenohydrins or halogenocarboxamides, for example chloroacetamide.

It is also possible to use mixtures of these cationic assistants.

Cationic assistants which have been found to be particularly suitable are produced by using dimethyl sulfate, diethyl sulfate or $C_1$–$C_2$-alkyl halides, for example methyl chloride or methyl iodide, to quaternise products of adducts of 2 to 35 mol of ethylene oxide and if desired in addition 1 mol of styrene oxide on alkylamines or alkenyl-amines having 12 to 24 carbon atoms or mixtures thereof.

Examples of preferred mixtures of foam-forming agents are combinations of components (1), (2), (3), (4), (5) and (6) and especially those of (A) alkylsulfonates having 8 to 20 carbon atoms and fatty alcohols having 12 to 22 carbon atoms or adducts of 1 to 4 mol of ethylene oxide on these fatty alcohols, (B) adducts of 2 to 12 mol of ethylene oxide on 1 mol of alkylphenol having 4 to 12 carbon atoms in the alkyl moiety, sodium salts of sulfate esters of fatty alcohol-/ethylene oxide adducts having 10 to 12 carbon atoms in the alcohol moiety and 2 to 4 ethylene oxide units, and fatty acid diethanolamides having 8 to 18 carbon atoms in the fatty acid radical, (C) adducts of 1 to 15 mol of ethylene oxide on 1 mol of fatty alcohol having 12 to 22 carbon atoms, and fatty acid diethanolamides having 8 to 18 carbon atoms in the fatty acid radical, (D) sodium salts of sulfate esters of fatty alcohol/ethylene oxide adducts having 10 to 22 carbon atoms in the alcohol moiety and 2 to 4 ethylene oxide units, fatty acid diethanolamides having 8 to 18 carbon atoms in the fatty acid radical and if desired adducts of 1 to 4 mol of ethylene oxide on $C_{12}$–$C_{22}$-fatty alcohols, (E) sodium salts of sulfate esters of fatty alcohol/ethylene oxide adducts having 10 to 22 carbon atoms in the alcohol moiety and 2 to 4 ethylene oxide units, fatty acid diethanolamides having 8 to 18 carbon atoms in the fatty acid radical, alkylbenzenesulfonates having 8 to 12 carbon atoms in the alkyl moiety and if desired in addition the disodium salt of 1-benzyl-2-$C_{17}$–$C_{18}$-alkylbenzimidazoldisulfonic acid, (F) a sulfate ester or its salts of an adduct of 2 to 15 mol of ethylene oxide on 1 mol of an aliphatic monoalcohol having 8 to 18 carbon atoms or in particular on 1 mol of an alkylphenol having 4 to 12 carbon atoms in the alkyl radical and an adduct of 3 to 10 mol of ethylene oxide and 3 to 10 mol of propylene oxide on 1 mol of an aliphatic monoalcohol having 8–16 carbon atoms, or (G) a sulfate ester or its salts (in particular diethanolamine salts) of an adduct of 2 to 15 mol of ethylene oxide on 1 mol of an aliphatic monoalcohol having 8 to 8 carbon atoms, a fatty acid diethanolamide having 8 to 18 carbon atoms in the fatty acid radical, a dialkylnaphthalenesulfonate having 3 to 5 carbon atoms per alkyl radical and if desired an adduct of 2 to 80 mol of ethylene oxide on 1 mol of fatty alcohol having 12 to 22 carbon atoms and/or an adduct, quaternised with dimethyl sulfate, of 1 mol of styrene oxide and 10 to 30 mol of ethylene oxide on 1 mol of fatty amine having 12 to 22 carbon atoms.

The foam-forming mixtures can be prepared by simply stirring the components with water. If desired, the foam-forming agents can be added to the treatment liquors in the form of one or more mixtures. The individual mixtures can also serve as foam moderators, foam stabilisers or wetting agents.

The amounts in which the foam-forming agents are added to the treatment liquors, preferably in the form of mixtures, vary with the printing method between 2 and 50 g, preferably between 2.5 and 20 g, per liter of treatment liquor to be foamed.

The dyes which can be used in the process according to the invention are the vat dyes which are customarily used for dyeing or printing cellulose textile materials.

Examples of said vat dyes are highly fused and heterocyclic benzoquinones or naphthoquinones, sulfur dyes and in particular anthraquinoid or indigoid dyes. Examples of vat dyes which can be used according to the invention are listed in the Colour Index 3rd edition (1971) volume 3 on pages 3649 to 3837 under the headings "Sulphur Dyes" and "Vat Dyes".

The amount of dye generally depends on the desired depth of shade and advantageously is 0.1 to 100 g per liter of print paste, preferably 5 to 60 g per liter of print paste.

The reducing agent used for converting (vatting) the vat dyes into the leuco compound, in which form the dye has affinity for the fibre, is for example sodium dithionite (sodium hydrosulfite). Vatting takes place in an alkaline medium. Examples of alkaline compounds used are sodium carbonate, sodium bicarbonate, sodium hydroxide, disodium phosphate, trisodium phosphate, borax, aqueous ammonia and alkali donors, for example sodium trichloroacetate.

The process according to the inVention is particularly suitable for printing textiles which consist of or contain cellulose.

The cellulose material can be regenerated or in particular natural cellulose, for example staple viscose, filament viscose, cellulose acetate, hemp, linen, jute or preferably cotton, or fibre blends, for example nylon/-cotton or in particular polyester/cotton, in which the polyester portion can be printed at the same time, with disperse dyes.

The textile material can be present in any form, for example as yarn, hank, woven fabric, knitted fabric, felt, preferably in the form of textile sheetlike structures, such as woven or knitted fabrics which wholly or partly consist of natural, regenerated or modified cellulose.

The preparations to be foamed are advantageously prepared by dissolving the dye and by adding the acrylamide polymer, the foam-forming agents, the alkalis and reducing agents. The preparations can contain further customary additives, for example electrolytes such as sodium chloride or sodium sulfate, glucose, urea, reduction catalysts, fixation accelerants, protective colloids, sulfobetaines, sequestrants or, depending on the print paste, also levelling agents and wetting agents. The addition of thickening agents is not necessary.

The pH of the print pastes is generally 8 to 13.5, preferably 9 to 13.

The foams can be produced using the commercially available foaming apparatus, in which the foams are prepared in the absence of air by means of non-oxidising propellants, for example nitrogen, if desired also continuously.

According to the invention, the foaming ratio, i.e. the ratio of the volume of the unfoamed preparation to the volume of the foamed preparation, is 1:2 to 1:100, advantageously 1:3 to 1:30, preferably 1:4 to 1:20.

The foams used according to the invention are distinguished in that they are thick, dense and stable, i.e. are durable and usable over a prolonged period. The foams used according to the invention preferably have half-lives of 1 minute to 6 hours, preferably 10 minutes to 1 hour.

The foams can be evenly applied to the fibre materials by a very wide range of techniques. Examples of possible techniques are: sucking, blowing, pressing, and printing. The foamed paste can be applied with the machines suitable in textile printing. The foam is advantageously applied by means of a screen-printing machine, preferably within a sealed system. Systems of this type are described for example in German Offenlegungsschriften Nos. 3,034,802 and 3,034,803.

The foams can be applied at a temperature of 10° to 105° C. They are preferably applied at room temperature, i.e. at about 15° to 30° C. The foam is generally applied in an amount of 10 to 120, in particular 15 to 50, percent on weight of fibre.

On contact with the fabric the foam is immediately dewatered. If desired, the application of foam can be repeated on the back of the fabric. It is also possible to apply different print foams to the front and the back of the textile material.

Preferably, the foam application according to the invention is effected by, first, foaming up the treatment liquor in a suitable apparatus within a sealed system, for example under pressure, and in an inert atmosphere, for example in a nitrogen atmosphere, and transporting the resulting foam by means of pipes to the application apparatus. The foam is then applied to the textile sheetlike structure, preferably through a sieve or a sievelike intermediate carrier, whereupon the foam is sucked, forced or pressed into the cloth. The sieve or sievelike intermediate carrier can be a sheet of perforated metal, a mesh, a net, a wire fabric, a sieve drum or a sieve screen.

Said procedures have the effect of destroying the structure of the foam by bursting the foam bubbles, whereupon the foam dewaters and the textile material is uniformly wetted.

After the foam application the printed textile material is subjected to a heat treatment if necessary, and is then conventionally oxidised, soaped and finished.

The heat treatment generally takes the form of steaming in the absence of air. It can also be effected by means of microwaves. In that case, the cloth, after impregnation with the print foam, is treated in a box in the absence of air by means of microwaves.

In the steaming process, the textile materials which have been printed with the foamed paste are subjected to a treatment at a temperature of advantageously, 60° to 120° C., preferably 100° to 106° C., in a steamer with saturated or superheated steam. Depending on the temperature, steaming can take 15 to 120 seconds.

The microwave treatment can take about 15 seconds to 30 minutes. Preferably, 1 to 15 minutes are sufficient. Microwaves are the electromagnetic waves (radio waves) within the frequency range from 300 to 100,000 MHz, preferably 1,000 to 30,000 MHz.

After the colouring process, the coloured cellulose-containing textile material can be washed out in conventional manner in order to remove unfixed dye and to develop the final hue of the dyeing. To this end, the substrate is treated for example at between 40° C. and the boil in a solution which contains soap or synthetic detergent.

The process according to the invention produces level and strong prints which are distinguished by crispness and good handle. Furthermore, the end-use fastness properties of the coloured cloth, for example light fastness, rub fastness and wet fastness properties, are not adversely affected by using the acrylamide polymer of the type defined.

In particular, by means of the foam application according to the invention it is possible to obtain prints with vat dyes on cellulose-containing textiles without using the customary thickeners, for example alginates, cellulose derivatives, starch ethers or bean flour ethers, such as carob bean flour ether, which are generally used in large amounts. According to the invention, prints of excellent crispness are obtained even in the presence of low amounts of the acrylamide polymers of the type defined.

In the following preparative methods and examples, the parts and percentages are by weight, unless otherwise stated.

The quantities in the case of the dyes relate to commercially available, i.e. diluent-containing, material and in the case of the assistants to the pure substance. The five-digit Colour Index numbers (C.I.) refer to the 3rd edition of the Colour Index.

PREPARATIVE METHODS

Method 1:

A solution of 22.5 g of acrylamide, 2.5 g of an adduct of 52 mol of propylene oxide on 1 mol of glycerol and 0.04 g of potassium peroxodisulfate in 200 g of water is heated with stirring and passing over of nitrogen to 50° C. and is held at that temperature for 3 hours. A solution of 0.03 g of potassium peroxodisulfate in 40 g of water is then added dropwise in the course of 60 minutes, and the very viscous solution is diluted by adding 300 ml of water in the course of 30 minutes. The reaction mixture is then maintained at 50° C. for 5 hours, then has added to it 0.6 g of hydroquinone monomethyl ether and 0.12 g of sodium azide, and is cooled down to room temperature with stirring. The result is 565 g of a gel having a polymer content of 4.4%. This gel has a viscosity, measured at 25° C., of 112,957 mpas.

Method 2:

A solution of 71.25 g of acrylamide, 3.75 g of an adduct of propylene oxide and glycerol having an average molecular weight of 4,200 and 0.09 g of potassium peroxodisulfate in 600 g of water is presented heated with stirring and passing over of nitrogen to 50° C. and is maintained at 50° C. for 3 hours. The viscosity of the solution gradually increases. A solution of 0.06 g of potassium peroxodisulfate in 120 g of water is added dropwise in the course of 60 minutes. About 10 minutes after the start of the dropwise addition the solution becomes so viscous that it is necessary to add 600 g of water during the subsequent 20 minutes. When the dropwise addition of the potassium peroxodisulfate solution is complete, the increasingly viscous solution is held at 50° C. for a further 5 hours and is diluted with an additional 400 g of water added a little at a time. 1.7 g of hydroquinone monomethyl ether are added, the mixture is cooled with stirring to room temperature and the result is 1,794 g of a free-flowing gel having a polymer content of 4.3%. This gel has a viscosity, measured at 25° C., of 64,202 mPas.

Method 3:

A solution of 71.25 g of acrylamide, 3.75 g of an adduct of propylene oxide and pentaerythritol having an average molecular weight of 3,350 and 0.09 g of potassium peroxodisulfate in 600 g of water is heated with stirring and passing over of nitrogen to 50° C. and is maintained at 50° C. for 3 hours. The viscosity of the solution gradually increases. A solution of 0.06 g of potassium peroxodisulfate in 120 g of water is then added dropwise in the course of 60 minutes. About 30 minutes after the dropwise addition has ended the viscosity of the solution increases. For that reason, 600 g of water are added during the subsequent 20 minutes. The increasingly viscous solution is then maintained at 50° C. for a further 4 hours, is thereafter diluted with an additional 400 g of water, has 3.4 g of triethanolamine added to it and is cooled down to room temperature with stirring, the result being 1,793 g of a still fluent gel having a solids content of 4.0%. This gel has a viscosity, measured at 25° C., of 75,300 mPas.

Method 4:

A solution of 17.8 g of acrylamide, 0.94 g of an adduct of 70 mol of propylene oxide and 6 mol of ethylene oxide on 1 mol of glycerol and 0.025 g of potassium peroxodisulfate in 250 g of water is heated with stirring and passing over of nitrogen to 50° C. and is maintained at that temperature for 3 hours. The temperature of the solution is raised to 60°-63° C. in the course of 20 minutes until the viscosity shows an appreciable increase, and is then cooled down to 55° C. The increasingly viscous solution is maintained at 55° C. for 5 hours. The viscous solution then has added to it a solution of 0.45 g of chloroacetamide and 0.45 g of hydroquinone monomethyl ether in 177 g of water, the result being 446 g of a gel having a graft polymer content of 4.2%. This gel has a viscosity, measured at 25° C., of 96,750 mPas.

Method 5:

Replacing the indicated adduct in method 4 by a further adduct of 53 mol of propylene oxide on 1 mol of trimethylolpropane affords 446 g of a gel having a graft polymer content of 4.2%. This gel has a viscosity, measured at 25° C., of 19,500 mPas.

Method 6:

A solution of 17.24 g of acrylamide, 4.31 g of an adduct of 70 mol of propylene oxide on 1 mol of glycerol and 0.035 g of potassium peroxodisulfate in 200 g of water is heated with stirring and passing over of nitrogen to 50° C. and is maintained at that temperature for 4 hours. The increasingly viscous solution is then heated at 55° C. for 5 hours. The gel has added to it a solution of 0.4 g of chloroacetamide and 0.4 g of hydroquinone monomethyl ether in 291 g of water, the result being 513 g of a gel having a polymer content of 4.2%. This gel has a viscosity, measured at 25° C., of 25,750 mPas.

Method 7:

A mixture of 15.1 g of acrylamide, 6.5 g of an adduct of 70 mol of propylene oxide on 1 mol of glycerol and 0.025 g of potassium peroxodisulfate in 200 g of water is heated with stirring and passing over of nitrogen to 50° C. and is maintained at that temperature for 3 hours. The increasingly viscous solution is then heated at 55° C. for 5 hours. The gel has added to it a solution of 0.4 g of chloroacetamide and 0.4 g of hydroquinone monomethyl ether in 291 g of water, the result being 512 g of a gel having a polymer content of 4.2%. This gel has a viscosity, measured at 25° C., of 16,300 mPas.

Method 8:

A mixture of 13 g of acrylamide, 8.7 g of an adduct of 70 mol of propylene oxide on 1 mol of glycerol and 0.015 g of potassium peroxodisulfate in 150 g of water is heated with stirring and passing over of nitrogen to 50° C. and is maintained at that temperature for 4 hours. The increasingly viscous solution is then heated at 65° C. for 2 hours and a further 3 hours at 60° C. The gel has added to it a solution of 0.4 g of chloroacetamide and 0.4 g of hydroquinone monomethyl ether in 347 g of water, the result being 519 g of a gel having a polymer content of 4.2%. This gel has a viscosity, measured at 25° C., of 15,582 mPas.

EXAMPLE 1

A print paste is prepared to contain in 1 liter of water the following additives:

30 g of a commercially available dye of the formula

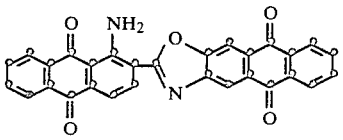

2.7 g of a mixture of
- the di-(β-hydroxyethyl)amine salt of the acid sulfate ester of the adduct of 3 mol of ethylene oxide on 1 mol of lauryl alcohol and
- cocoacid-N-di-β-hydroxyethylamide (1:1)

1.2 g of a mixture of 13 parts of the adduct, quaternised with
- dimethyl sulfate, of 1 mol of styrene oxide and 15 mol of ethylene oxide on 1 mol of oleylamine,
- 13 parts of dibutylnaphthalenesulfonic acid and 7 parts of the adduct of 80 mol of ethylene oxide on 1 mol of oleyl alcohol, 3 g of the graft polymer prepared in method 2,
100 ml of a 30% aqueous sodium hydroxide solution and 20 g of sodium sulfate.

The print paste then has added to it 50 g of sodium hydrosulfite and is foamed up with nitrogen within a sealed system in a foaming apparatus. The foaming ratio is 1:10.

This foam is forced under pressure (0.60 bar) through pipes and by way of a sieve screen onto a cotton fabric. The printed fabric is then steamed at 102° C. for 30 seconds, is oxidised in air and is then rinsed, soaped, rinsed again and dried in conventional manner.

The result of this efficient procedure is a level and crisp red print having excellent end-use fastness properties.

Similarly good prints are obtained if, instead of using the graft polymer prepared in method 2, equal amounts are used of graft polymers prepared in methods 1 and 3 to 8 and of polyacrylamide in the form of a 4% aqueous solution having a viscosity, measured at 25° C., of 28,000 cps.

EXAMPLE 2

A print paste is prepared to contain in 1 liter of water the following additives:
10 g of the dye Vat Blue 43 C.I. 53,630
2.7 g of a mixture of
- the di-(β-hydroxyethyl)amine salt of the acid sulfate ester of the adduct of 3 mol of ethylene oxide on 1 mol of lauryl alcohol and
- cocoacid-N-di-β-hydroxyethylamide (1:1)

1.2 g of a mixture of
- 13 parts of the adduct, quaternised with dimethylsulfate, of 1 mol of styrene oxide and 15 mol of ethylene oxide on 1 mol of oleylamine,
- 13 parts of dibutylnaphthalenesulfonic acid and 7 parts of the adduct of 80 mol of ethylene oxide on 1 mol of oleyl alcohol 3 g of the graft polymer prepared in method 2,
1.5 g of a mixture of
- 20 parts of a 50% aqueous solution of polymaleic anhydride (molecular weight 600)
- 9 parts of the disodium salt of di-(6-sulfonaphth-2-yl)1-methane
- 15 parts of the sodium salt of an acid phosphate ester of a fatty alcohol polyethoxylate 30 ml of a 30% aqueous sodium hydroxide solution and 20 g of sodium sulfate.

The print paste is then vatted with 10 g of sodium hydrosulfite and is foamed with nitrogen within a sealed system using a foaming apparatus. The foaming ratio is 1:23.

This foam is forced under pressure through pipes and by way of a sieve screen onto a cotton fabric. The fabric is then oxidised in air and subsequently rinsed, soaped, rinsed again and dried.

The result is a crisp pale blue print having good end-use fastness properties.

EXAMPLE 3

A print paste is prepared to contain in 1 liter of water the following additives:
10 g of the dye Vat Green 1 C.I. 59,825
100 g of an aqueous mixture which contains 7.5 g of an adduct of 2 mol of ethylene oxide on 1 mol of cetyl alcohol and 0.025 g of sodium lauryl sulfate,
15 g of the graft polymer prepared in method 2
5 g of a mixture of
- 20 parts of a 50% aqueous solution of polymaleic anhydride (molecular weight 600)
- 9 parts of the disodium salt of bi-(6-sulfonaphth-2-yl)methane and 15 parts of the sodium salt of an acid phosphate ester of a fatty alcohol polyethoxylate and 40 ml of 30% aqueous sodium hydroxide solution.

The print paste is then vatted with 16 g of sodium hydrosulfite and is foamed with nitrogen within a sealed system using a foaming apparatus. The foaming ratio is 1:8.

This foam is forced under pressure through pipes and by way of a sieve screen onto a cotton fabric. The fabric is then oxidised in air and subsequently rinsed, soaped, rinsed again and dried.

The result is a crisp pale green print having good end-use fastness properties.

Similarly good prints are obtained on replacing the graft polymer prepared in method 2 by equal amounts of the graft polymers prepared in methods 1 and 4.

EXAMPLE 4

A print paste is prepared to contain in 1 liter of water the following additives:
25 g of Vat Green 1 C.I. 59,825
5 g of a mixture of
- the di-(β-hydroxyethyl)amine salt of the acid sulfate ester of the adduct of 3 mol of ethylene oxide on 1 mol of lauryl alcohol and
- cocoacid-N-di-β-hydroxyethylamide (1:1)

5 g of a mixture of
- 13 parts of the adduct, quaternised with dimethyl sulfate, of 1 mol of styrene oxide and 15 mol of ethylene oxide on 1 mol of oleylamine,
- 13 parts of dibutylnaphthalenesulfonic acid and 7 parts of the adduct of 80 mol of ethylene oxide on 1 mol of oleyl alcohol, 5 g of a mixture of
- 20 parts of a 50% aqueous solution of polymaleic anhydride (molecular weight 600),
- 9 parts of the disodium salt of di-(6-sulfonaphth-2-yl) methane and
- 15 parts of the sodium salt of an acid phosphate ester of a fatty alcohol polyethoxylate and 50 ml of 30% aqueous sodium hydroxide solution.

The print paste is then vatted with 25 g of sodium hydrosulfite and is foamed with nitrogen within a sealed system using a foaming apparatus. The foaming ratio is 1:13.

This foam is forced under pressure through pipes and by way of a sieve screen onto a cotton fabric. The fabric is then steamed at 102° C. for 30 seconds, is oxidised in air and is then rinsed, soaped, rinsed again and dried.

The result is a level green print having good end-use fastness properties.

We claim:

1. A process for dyeing or printing cellulose-containing textile materials with vat dyes, which comprises contacting the textile material with an aqueous preparation, which is foamed in the absence of air, and which contains dye, foam-forming agent, alkali, reducing agent and a homopolymer or copolymer of acrylamide or methacrylamide or a graft polymer which comprises an adduct of an alkylene oxide on an at least trihydric aliphatic alcohol having 3 to 10 carbon atoms and acrylamide or methacrylamide.

2. A process according to claim 1, wherein the preparation contains the polymer in an amount of 0.1 to 20 g in the form of an aqueous solution per liter of unfoamed preparation.

3. A process according to claim 1, wherein the preparation contains the polymer in an amount of 0.5 to 10 g, in the form of a 2 to 10% aqueous solution per liter of unfoamed preparation.

4. A process according to claim 1, wherein the preparation contains a graft polymer which is obtainable by graft polymerisation of acrylamide or methacrylamide on an adduct of 4 to 100 mol of propylene oxide on a trihydric to hexahydric alkanol having 3 to 6 carbon atoms.

5. A process according to claim 1, wherein the graft polymer contains 2.5 to 50% by weight of the adduct and 50 to 97.5% by weight of the grafted-on acrylamide or methacrylamide, based on the graft polymer.

6. A process according to claim 5, wherein the graft polymer contains 2.5 to 30% by weight of the adduct and 70 to 97.5% by weight of the grafted-on acrylamide or methacrylamide, based on the graft polymer.

7. A process according to claim 1, wherein the graft polymer has been prepared from acrylamide and an adduct of 40 to 80 mol of propylene oxide on 1 mol of glycerol.

8. A process according to claim 7, wherein the graft polymer contains 4 to 20% by weight of the adduct of 40 to 80 mol of propylene oxide on 1 mol of glycerol and 80 to 96% by weight of grafted-on acrylamide, based on the graft polymer.

9. A process according to claim 1, wherein the preparation contains as the foam-forming agent a mixture of alkylsulfonates having 8 to 20 carbon atoms and fatty alcohols having 12–22 carbon atoms or adducts of 1 to 4 mol of ethylene oxide on 1 mol of these fatty alcohols.

10. A process according to claim 1, wherein the preparation contains as the foam-forming agent a mixture of adducts of 2 to 12 mol of ethylene oxide on 1 mol of alkylphenol having 4 to 12 carbon atoms in the alkyl moiety, sodium salts of sulfate esters of fatty alcohol-/ethylene oxide adducts having 10 to 12 carbon atoms in the alcohol moiety and 2 to 4 ethylene oxide units, and fatty acid diethanolamides having 8 to 18 carbon atoms in the fatty acid radical.

11. A process according to claim 1, wherein the preparation contains as the foam-forming agent a mixture of adducts of 1 to 15 mol of ethylene oxide on 1 mol of fatty alcohol having 12 to 22 carbon atoms and fatty acid diethanolamides having 8 to 18 carbon atoms in the fatty acid radical.

12. A process according to claim 1, wherein the preparation contains as the foam-forming agent a mixture of sodium salts of sulfate esters of fatty alcohol/ethylene oxide adducts having 10 to 22 carbon atoms in the alcohol moiety and 2 to 4 ethylene oxide units, and fatty acid diethanolamides having 8 to 18 carbon atoms in the fatty acid radical.

13. A process according to claim 1, wherein the preparation contains as the foam-forming agent a mixture of sodium salts of sulfate esters of fatty alcohol/ethylene oxide adducts having 10 to 22 carbon atoms in the alcohol moiety and 2 to 4 ethylene oxide units, fatty acid diethanolamides having 8 to 18 carbon atoms in the fatty acid radical and alkylbenzenesulfonates having 8 to 12 carbon atoms in the alkyl moiety.

14. A process according to claim 1, wherein the preparation contains as the foam-forming agent a mixture of a sulfate ester or its salts of an adduct of 2 to 15 mol of ethylene oxide on 1 mol of an aliphatic monoalcohol having 8 to 18 carbon atoms or on 1 mol of an alkylphenol having 4 to 12 carbon atoms in the alkyl radical and an adduct of 3 to 10 mol of ethylene oxide and 3 to 10 mol of propylene oxide on an aliphatic monoalcohol having 8 to 16 carbon atoms.

15. A process according to claim 1, wherein the preparation contains as foaming agent a mixture of a sulfuric acid ester or its salts of an adduct of 2 to 15 moles of ethylene oxide on 1 mole of an aliphatic monoalcohol having 8 to 18 carbon atoms, a fatty acid diethanolamide having 8 to 18 carbon atoms in the fatty acid radical and a dialkylnaphthalenesulfonate having 3 to 5 carbon atoms per alkyl radical.

16. A process according to claim 1, wherein the preparation contains as the foam-forming agent a mixture of a sulfate ester or its salts of an adduct of 2 to 15 mol of ethylene oxide on 1 mol of an aliphatic monoalcohol having 8 to 18 carbon atoms, a fatty acid diethanolamide having 8 to 18 carbon atoms in the fatty acid radical, a dialkylnaphthalenesulfonate having 3 to 5 carbon atoms per alkyl radical, an adduct of 2 to 80 mol of ethylene oxide on 1 mol of fatty alcohol having 12 to 22 carbon atoms and an adduct, quaternised with dimethyl sulfate, of 1 mol of styrene oxide and 10 to 30 mol of ethylene oxide on one mol of fatty amine having 12 to 22 carbon atoms.

17. A process according to claim 1, wherein the foamed preparation is used in a nitrogen atmosphere.

18. A process according to claim 1, wherein printing is effected by means of a screen-printing machine.

19. A process according to claim 18, wherein the preparation is applied to a sieve or sievelike intermediate carrier and is forced through said sieve or sievelike intermediate carrier.

20. A process according to claim 1, wherein the dye is subsequently fixed by a heat treatment.

21. A process according to claim 20, wherein the heat treatment is carried out by steaming.

22. An aqueous preparation for dyeing or printing cellulose-containing textile material with vat dyes, which contains dye, foam-forming agent, reducing agent, alkalis and a homopolymer or copolymer of acrylamide or methacrylamide or a graft polymer which is obtainable from an adduct of an alkylene oxide on an at least trihydric aliphatic alcohol having 3 to 10 carbon atoms and acrylamide or methacrylamide.

23. An aqueous preparation according to claim 22, in foamed form.

24. A process for dyeing or printing cellulose-containing textile material with vat dyes, which comprises:

a. foaming, in the absence of air, an aqueous liquor which comprises dye, foam-forming agent, alkali, reducing agent and a homopolymer or copolymer of acrylamide or methacrylamide or a graft polymer which comprises an adduct of an alkylene oxide on an at least trihydric aliphatic alcohol having 3 to 10 carbon atoms and acrylamide or methacrylamide;

b. contacting, in the absence of air, said foamed aqueous liquor with the textile material to be printed or dyed until the material is uniformly wetted;

c. heat treating, in the absence of air, the wetted material;

d. treating the material with an oxidizing agent in an amount and for a time sufficient to destroy residual reducing agent; and e. soaping and finishing the dyed or printed textile material.

* * * * *